US005353555A

United States Patent [19]

Moore

[11] Patent Number: 5,353,555

[45] Date of Patent: Oct. 11, 1994

[54] ROAD TRANSPORTABLE LOCKER ROOM

[75] Inventor: J. Thomas Moore, Charleston, W. Va.

[73] Assignee: The Moore Company, Charleston, W. Va.

[21] Appl. No.: 950,995

[22] Filed: Sep. 25, 1992

[51] Int. Cl.[5] ..... E04H 1/12

[52] U.S. Cl. ..... 52/79.1; 52/79.9; 52/79.13; 52/127.1

[58] Field of Search ..... 52/637, 79.1, 79.9, 52/127.1, 79.13; 220/4.26, 4.27, 23.6

[56] References Cited

U.S. PATENT DOCUMENTS

| | | | |
|---|---|---|---|
| 3,552,059 | 1/1971 | Moore . | |
| 4,057,211 | 11/1977 | Moore | 248/332 |
| 4,470,227 | 9/1984 | Bigelow, Jr. et al. | 52/79.1 |
| 4,553,276 | 11/1985 | Paradis | 52/79.1 |

FOREIGN PATENT DOCUMENTS

| | | | |
|---|---|---|---|
| 3926124 | 2/1991 | Fed. Rep. of Germany | 52/79.1 |
| 9111568 | 8/1991 | PCT Int'l Appl. | 52/79.9 |

*Primary Examiner*—Carl D. Friedman
*Assistant Examiner*—Christopher T. Kent
*Attorney, Agent, or Firm*—Cushman, Darby & Cushman

[57] ABSTRACT

A road transportable locker room includes a base module and a stack module. The base module includes a floor and side walls that extend generally transverse to the floor. The stack module includes a roof and side walls that extend generally transverse to the roof. A guide plate is affixed to the base module and an aligning plate is affixed to the stack module. When the stack module is being mounted on the base module, the guide plate and aligning plate cooperate to perform a substantially equal and opposite corrective force upon the base module and the stack module. A plurality of articles storage devices are suspended by a cable. A first row of clip angles bars is attached to one of the side walls of the base module at a specified distance above the floor of the base module. A second row of clip angles is attached to the side walls of the stack module at a specified distance above the base of the side walls of the stack module. A locking device is associated with each cable and is secured to the attachment bar. When the attachment bar is moved from the first row of clip angles to the second row of clip angles, the article storage device descends but still remains above the base of the side walls of the stack module.

13 Claims, 3 Drawing Sheets

ROAD TRANSPORTABLE LOCKER ROOM

BACKGROUND OF THE INVENTION

1. Field of the Invention

The present invention relates to a road transportable locker room, in particular, to a locker room including a base module and a stack module structured to allow the stack module to be automatically aligned onto the base module during assembly.

2. Description of the Related Art

In remote work areas, such as mining camps, logging operations, and in many interstate highway construction projects, facilities for the safe storage of street clothes, as well as the overnight or off-work period storage of work clothes together with the provision of wash-up and toilet facilities for the workers have been expensive to provide, on the one hand, and, on the other hand, when actually provided have been relatively rudimentally in condition, thus making them undesirable for use by a number of workers. In addition, in remote facilities, the safe storage of street clothes and valuables has always presented a problem in view of the lack of ready police protection and due to the expense of providing security personnel to watch over the stored valuables.

In recent years, the use of corporations or companies that provide contract labor for other corporations have come into widespread use, particularly in the mining fields. However, to attract capable labor in large numbers, such contractor labor concerns had to provide locker room facilities for the workers that were both clean and sanitary and were capable of safeguarding the workers' valuables during their working hours in order to be able to attract and retain competent trained personnel.

In addition, a number of local jurisdictions have enacted legislation, requiring certain minimum standards for workers locker room facilities which, as a practical matter, have made it relatively expensive to conduct construction or mining operations in remote areas, particularly where the locker room facilities would have to be abandoned if a particular site have been fully worked and the point at which labor was employed was removed to another site remote from the original, permanently established locker room facility.

Attempts have been made to solve the foregoing difficulties by providing a transportable locker room facility for a number of workers which can be utilized to provide storage for street clothes and valuables in a safe manner as well as to store the soiled worker clothes in condition such that clothing will be fully ventilated during a rest period, such as overnight, so as to be ready for use during the next work period. In addition, however, the transportable locker room with the present invention can readily provide shower and toilet facilities for the workers to enable the facility to comply with state and local legislation with respect to such facilities. In addition, the locker room can be employed on sports outings and other recreational pursuits.

SUMMARY OF THE INVENTION

The present invention provides a transportable locker room that includes a base module and a stack module. The stack module can be removed from the base module during transportation so that during transportation the modules can easily be transported over the public highways, as well as transporting over off road terrain to and from a selected site. This eliminates the necessity for a construction or mining firm to install permanent facilities at a site in order to comply with the health and labor ordinances in this field. When the stack module is assembled to the base module, the transportable locker room will accommodate the storage suspension system such as that disclosed in U.S. Pat. No. 4,057,211, the disclosure of which is incorporated herein by reference.

In a preferred embodiment, an aligning system for the modules allows the stack module to be mounted on the base module while automatically aligning both modules in both the horizontal and vertical directions. Further, a unique clip angle arrangement in both the stack module and the base module allows the locker baskets to be retained within the stack module when the stack module is removed from the base module.

Other objects, features and characteristics of the present invention, as well as the methods of operation and functions of the related elements of the structure, and the combination of parts and economies of manufacture, will become more apparent upon consideration of the following detailed description and the appended claims with reference to the accompanying drawings all of which form a part of this specification, wherein like reference numerals designate corresponding parts in the various figures.

DETAILED DESCRIPTION OF PRESENTLY PREFERRED EXEMPLARY EMBODIMENTS

Figure 1:
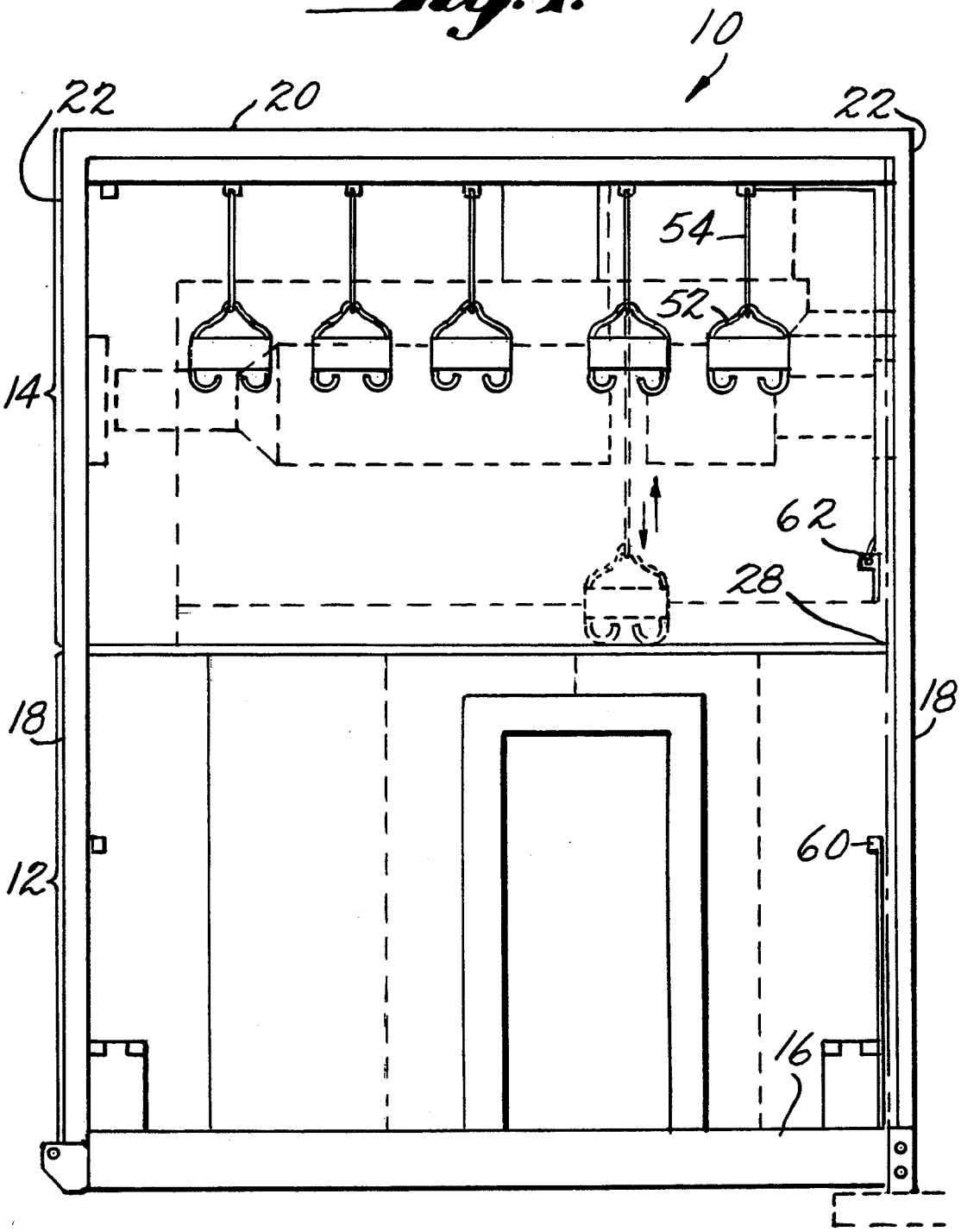
FIG. 1 is a cross-sectional view of the road transportable locker room.
Figure 2:
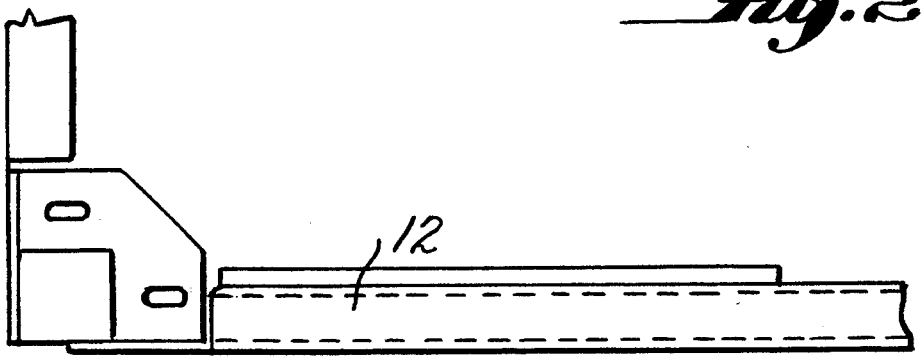
FIG. 2 is a plan view of the base module.
Figure 3:
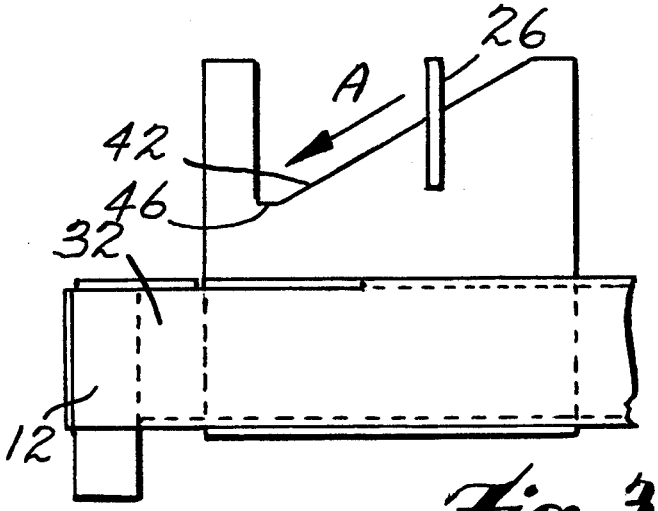
FIG. 3 is a side view of the base module with the aligning plate of the stack module shown being mounted onto the base module.

A road transportable locker room is shown by way of example, in FIG. 1. The assembly 10 includes a base module 12 and a stack module 14.

In the embodiment of FIG. 1, the base module is shown including a floor 16 and side walls 18. The side walls 18 extend generally transverse to the floor 16. The stack module 14 includes a roof 20 and side walls 22. The side walls 22 extend generally transverse to the roof 20. The stack module 14 is removably mounted on the base module 12.

As shown in FIGS. 2–6, the base and stack module include aligning means for automatically aligning the stack module on the base module when the stack module is being lowered or mounted on the base module. The aligning means preferably includes four guide plates 24, with a guide plate 24 being fixed to each upper corner of the base module 12. An aligning plate 26 is affixed to each lower corner of the stack module 14. During assembly of the stack module to the base module, the guide plates and aligning plate cooperate to perform a substantially equal and opposite corrective force upon the base module and the stack module to automatically align, both vertically and horizontally, the stack module and the base module.

Figure 4:
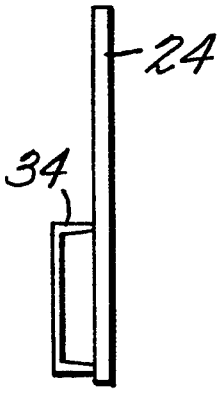
FIG. 4 is a side view of the base module showing the perimeter channel and the guide plate.
Figure 5:
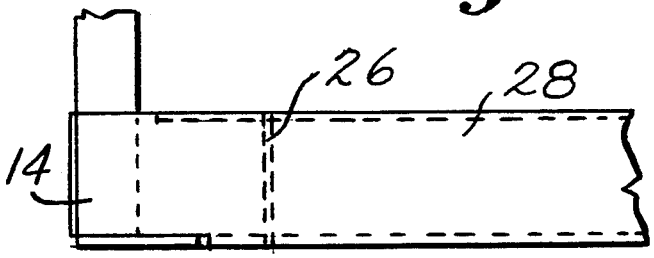
FIG. 5 is a side view of the stack module with the aligning plate shown in phantom.
Figure 6:
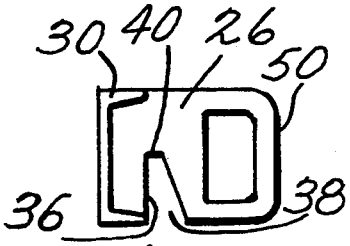
FIG. 6 is a side view of the stack module and the aligning plate.
Figure 8:
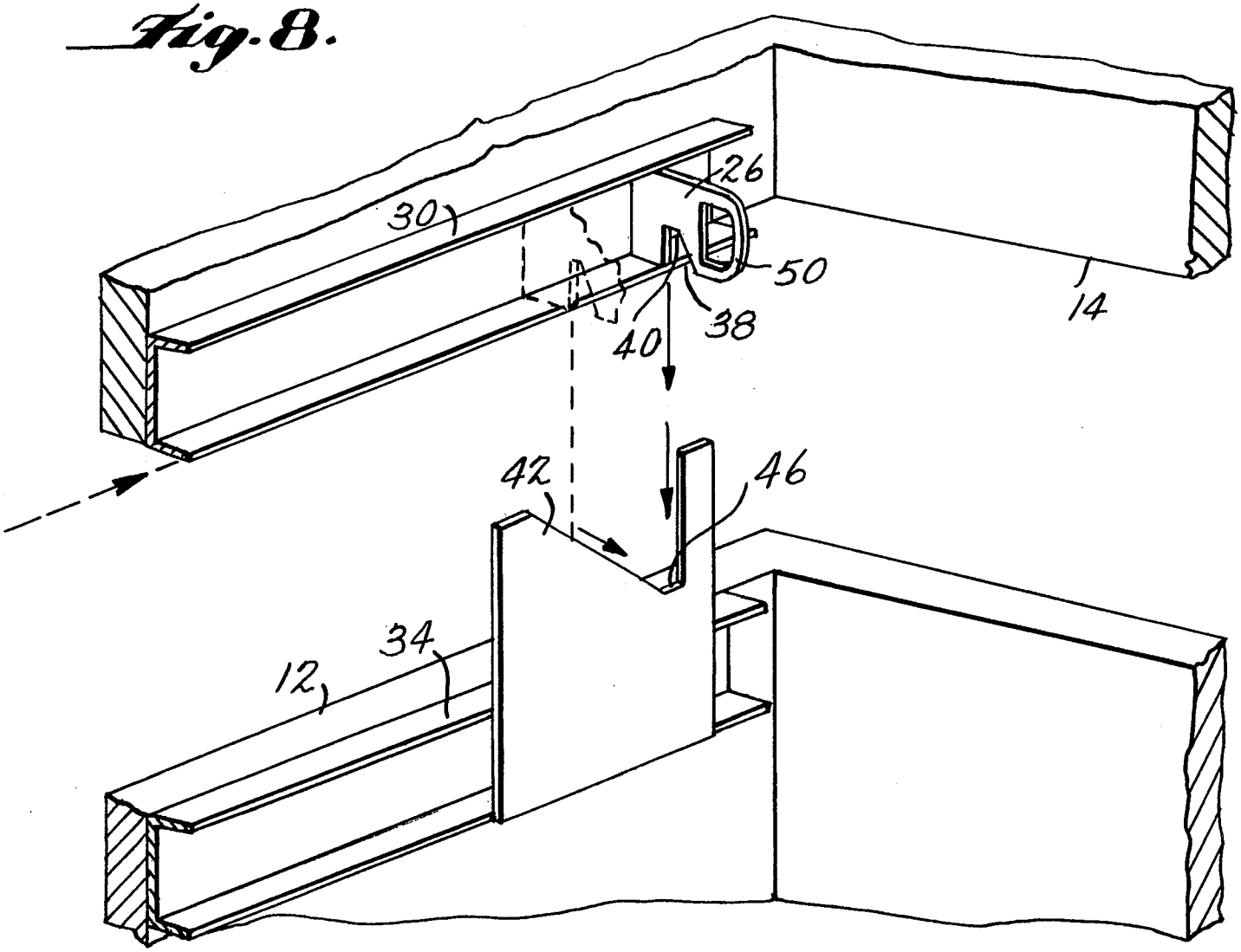
FIG. 8 is a perspective view of an inner corner of the base and the stack module.

One set of the aligning plate 26 and guide plate 24 is shown in FIGS. 2–6 and 8. At a base 28 of the side walls of the stack module is a perimeter channel 30. An aligning plate 26 is mounted on the inside of the perimeter channel 30 and protrudes inside the stack module, as shown in FIGS. 6 and 8. At a top rim 32 of the side walls of the base module 12, is a second perimeter channel 34. A guide plate 24 is mounted on the inside of the second perimeter channel 34 and protrudes inside the base module, as shown in FIGS. 4 and 8.

As shown in FIG. 6, the aligning plate 26 includes a wedge shape notch 36. The notch 36 has an opened bottom end 38 and a closed top end 40. The notch 36 is tapered toward its closed end.

The guide plate 24 includes a wedge shaped notch 42. The notch 42 has an opened top end 44 and a closed bottom end 46. The notch 42 is tapered toward its closed end 46. The aligning plate 76 is also shown with a handle 50 to assist mating the aligning plate notch 36 and the guide plate notch 42 when the stock module 14 is being lowered on the base module 12.

As shown in FIG. 8, during assembly of the stack module 14 to the base module 12, a user will roughly align the notch 36 in the aligning plate 26 with the notch 42 in the guide plate 24 through the use of the handle 50 on the aligning plate. Once the notches are aligned, the stack module 14 can be lowered onto the base module 12 as is shown by the arrows A and B in FIGS. 3 and 5. Therefore, if any misalignment has occurred during shipment of the stack module and the base module, the guide plate and aligning plate cooperate to perform a substantially equal and opposite corrective force upon the base module and the stack module and automatically align the stack module and base module in both the horizontal and vertical directions. Once the stack module and base module are assembled, the perimeter channel in the stack module and the base module mate.

Figure 7:
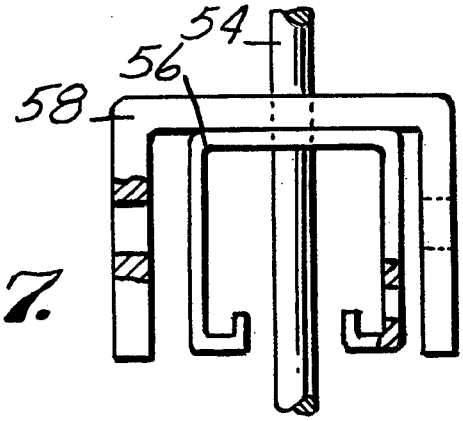
FIG. 7 is a side view of a clip angle.

As shown in FIG. 1, the stack module includes a plurality of article storage baskets 52 that are associated with a cable 54. As shown in greater detail in FIG. 7, each cable 54 includes a lock device 56 attached to the cable 54. An attachment bar 58 receives a lock device 56 as shown in FIG. 7.

As shown in FIG. 1, a first row of clip angles 60 is attached to one of the side walls of the base module 12 at a specified distance above the floor of the base module. A second row of clip angles 62 is attached to at least one of the side walls of the stack module 14 at a specified distance above the base of the side walls of the stack module. When a user moves the attachment bar, with the lock devices attached, from the first row of clip angles to the second row of clip angles, the article storage baskets 52 descend but still remain above the base 28 of the side walls of the stack module as shown in phantom in FIG. 1. The article storage baskets 52 are shown in FIG. 1 in a position when the lock device is attached to the attachment bar which in turn is attached to first row of clip angles 60 in the base module 12.

While the invention has been described in connection with what is presently considered to be the most practical and preferred embodiment, it is to be understood that the invention is not limited to the disclosed embodiment, but, on the contrary, is intended to cover various modifications and equivalent arrangements included within the spirit and scope of the appended claims.

What is claimed is:

1. A road transportable locker room comprising:

(a) a base module, said base module including a floor and side walls extending generally transverse to said floor;

(b) a stack module, said stack module including a roof and side walls extending generally transverse to said roof, said stack module being removably mounted on said base module; and (c) an aligning means for automatically aligning said stack module on said base module when said stack module is being mounted on said base module, said aligning means including at least one guide plate affixed to said base module and at least one aligning plate affixed to said stack module, said guide plate and aligning plate cooperating to provide a substantially equal and opposite corrective force upon said base module and said stack module during mounting of said stack module on said base module, said side walls of said stack module including a base and a first perimeter channel located adjacent said base of said side walls of said stack module, said first perimeter channel having an interior side, said aligning plate being mounted on said interior side of said first perimeter channel and protruding toward said interior side of said stack module.

2. The road transportable locker room according to claim 1 wherein said side walls of said base module include a top rim, said locker room further comprising a second perimeter channel having an interior side and being located at said top rim of said side walls of said base module, said guide plate being mounted on said interior side of said second perimeter channel and protruding inside of said base module.

3. The road transportable locker room according to claim 2, wherein said aligning plate includes a wedge shaped notch, said aligning plate notch having an open bottom end and a closed top end, said aligning plate notch having a closed end and being tapered toward said closed end.

4. The road transportable locker room according to claim 3, wherein said guide plate includes a wedge shaped notch, said guide plate notch having an open top end and a closed bottom end, said guide plate notch being tapered toward said closed end of said guide plate.

5. The road transportable locker room according to claim 4, wherein said aligning plate further includes a handle to assist in mating said aligning plate notch and said guide plate notch when said stack module is being mounted on said base module.

6. A road transportable locker room comprising:

(a) a base module, said base module including a floor and side walls extending generally transverse to said floor;

(b) a stack module, said stack module including a roof and side walls extending generally transverse to said roof from a base, said stack module being removably mounted on said base module;

(c) an aligning means for automatically aligning said stack module on said base module when said stack module is being mounted on said base module;

(d) said stack module having cable means for suspending a plurality of article storage means in closely spaced relation, each cable means including lock means with said cable means; and (e) a clip angle means for allowing the article storage means to be retained within said stack module when said stack module is removed from said base module, said clip angle means including:

(i) a first row of attachment bars being attached to at least one of the side walls of the base module at a specified distance above the floor of the base module; and (ii) a second row of attachment bars being attached to at least one of the side walls of the stack module at a specified distance above the base of said side walls of said stack module, such that when said lock means is moved from the first row of attachment bars to the second row of attachment bars, the article storage means descend and remain above said base of said side walls of said stack module.

7. The road transportable locker room according to claim 6 wherein said aligning means including at least one guide plate being affixed to said base module and at least one aligning plate being affixed to said stack module, said guide plate and aligning plate cooperate to perform a substantially equal and opposite corrective force upon said base module and said stack module.

8. The road transportable locker room according to claim 7 wherein said side walls of said stack module include a base and a first perimeter channel located adjacent said base of said side walls of said stack module, said first perimeter channel having an interior side, said aligning plate being mounted on said interior side of said first perimeter channel and protruding toward said interior side of said stack module.

9. The road transportable locker room according to claim 8 wherein said side walls Of said base module include a top rim, said locker room further comprising a second perimeter channel having an interior side and being located at said top rim of said side walls of said base module, said guide plate being mounted on said interior side of said second perimeter channel and protruding inside of said base module.

10. The road transportable locker room according to claim 9, wherein said aligning plate includes a wedge shaped notch, said aligning plate notch having an open bottom end and a closed top end, said aligning plate notch being tapered toward said closed end of said aligning plate.

11. The road transportable locker room according to claim 10, wherein said guide plate includes a wedge shaped notch, said guide plate notch having an open top end and a closed bottom end, said guide plate notch being tapered toward said closed end of said guide plate.

12. The road transportable locker room according to claim 11, wherein said aligning plate further includes a handle to assist in mating said aligning plate notch and said guide plate notch when said stack module is being mounted on said base module.

13. A road transportable locker room comprising:

(a) a base module, said base module including a floor and side walls extending generally transverse to said floor;

(b) a stack module, said stack module including a roof and side walls extending generally transverse to said roof, said stack module being removably mounted on said base module; and (c) an aligning means for automatically aligning said stack module on said base module when said stack module is being mounted on said base module, said aligning means including at least one guide plate affixed to said base module and at least one aligning plate affixed to said stack module, one of said guide plate and aligning plate extending substantially perpendicular to a side wall to which said plate is fixed and including a surface extending at an angle to said side wall, the other of said guide plate and aligning plate including a notch having an apex for engaging said surface so as to slide relative thereto to provide a substantially equal and opposite corrective force upon said base module and said stack module during mounting of said stack module on said base module, said side walls of said stack module including a base and an interior side, said aligning plate being mounted on said interior side and protruding toward said interior side of said stack module.

* * * * *